US006479011B2

(12) United States Patent
Kojima et al.

(10) Patent No.: US 6,479,011 B2
(45) Date of Patent: Nov. 12, 2002

(54) METHOD OF SCRAPPING FURNACE BOTTOM SECTION OF BLAST FURNACE

(75) Inventors: Hirotaka Kojima, Okayama (JP); Masao Fujita, Okayama (JP); Mitsuru Kiguchi, Okayama (JP); Hiroyuki Yasuhara, Okayama (JP); Yasuo Ochiai, Fukuoka (JP)

(73) Assignees: Kawasaki Steel Corporation (JP); Sankyu Inc. (JP)

( * ) Notice: Subject to any disclaimer, the term of this patent is extended or adjusted under 35 U.S.C. 154(b) by 26 days.

(21) Appl. No.: 09/737,352

(22) Filed: Dec. 15, 2000

(65) Prior Publication Data

US 2002/0014724 A1 Feb. 7, 2002

(30) Foreign Application Priority Data

Jul. 13, 2000 (JP) ..... 2000-212506
Jul. 13, 2000 (JP) ..... 2000-212507
Jul. 13, 2000 (JP) ..... 2000-212508

(51) Int. Cl.[7] ..... C21B 13/00
(52) U.S. Cl. ..... 266/44; 266/135; 266/DIG. 1
(58) Field of Search ..... 264/30; 266/197, 266/DIG. 1, 135, 44

(56) References Cited

FOREIGN PATENT DOCUMENTS

| | | | | |
|---|---|---|---|---|
| JP | 358045305 A | * | 3/1983 | ..... 266/DIG. 1 |
| JP | 403291319 A | * | 12/1991 | ..... 266/DIG. 1 |
| JP | 7-197112 | | 8/1995 | |
| JP | 10-96005 | | 4/1998 | |

* cited by examiner

*Primary Examiner*—Scott Kastler
(74) *Attorney, Agent, or Firm*—Schnader Harrison Segal & Lewis LLP

(57) ABSTRACT

A solidified residual iron within a blast furnace is suspended up by employing a shell suspending device fixed to a tuyere arranged in a lower end portion of an upper portion of a furnace body suspended by a lift jack and a solidified residual iron suspending band, thereafter is descended by employing the lift jack and is mounted on a horizontally moving table. Subsequently, the horizontally moving table mounting the solidified residual iron thereon is moved onto a furnace outer truck rail from a furnace inner truck rail so as to be taken out of the furnace by operating a center hole jack arranged near the furnace outer truck rail, whereby an operation of taking out the solidified residual iron within the blast furnace out of the furnace is economically performed for a short time.

14 Claims, 25 Drawing Sheets

(a)

(b)

METHOD OF SCRAPPING FURNACE BOTTOM SECTION OF BLAST FURNACE

FIELD OF THE INVENTION

This invention relates to a method of scrapping a furnace bottom section of a blast furnace, more particularly, to a method of scrapping a furnace bottom section of a blast furnace which can convey solidified residual iron left in the furnace bottom section after performing a blowing-down for revamping the blast furnace out of the furnace.

PRIOR ART

When operating a blast furnace for a long time, the brick lining is significantly corroded. When removing the corrosion, in an upper portion of the blast furnace, a crack is generated in the shell provided on the outer periphery as a pressure container and gas or the like is injected out, and in a lower portion of the blast furnace, carbon bricks in the furnace bottom section are corroded and dissolved material melts down the shell and flows out. In such a case, a water vapor explosion may be generated by stave cooling water or shell cooling water. Accordingly, the blast furnace is blown out and an inner portion thereof is revamped once every ten or so years.

At the time of revamping the blast furnace, an opening portion is formed by partly breaking the shell in the furnace bottom section of the blast furnace and the brick lining with construction machinery such as a back hoe, a shovel or the like, and the construction machinery is introduced into the inner portion of the furnace bottom section. Then, coke left in the furnace bottom section is removed from the furnace by the construction machinery. Thereafter, it is necessary that an operator enters the furnace and crushes solidified residual iron left in a lower portion thereof, the solidified residual iron mainly containing pig iron with which slag or coke is mixed, by employing a rock drill or blasting, to convey solidified residual iron out of the furnace.

The solidified residual iron is firmly integrated and hard to be decomposed, which is different from a collapsible solidified material, and is removed by blasting. It has been necessary to form a multiplicity of bores in the solidified residual iron by a boring drill or an oxygen lance prior to the blast and charge dynamite therein, prior to the blast. In this boring, blasting and dividing method mentioned above, since a long time is required, a long period is required for the construction, so that the blasting operation avoids other scrapping operations. Further, since the crushed materials are dispersed at the time of explosion and a significant danger and loud sound are generated, the operation performed in the periphery of the blast furnace is necessarily interrupted at the time of blasting.

In this case, since the period of the construction for revamping the blast furnace is required to be reduced as much as possible, the scrapping operation is started before the brick lining and the solidified residual iron within the furnace body are cooled to room temperature. Accordingly, the environment of the operation is a bad environment in which the temperature is high and a lot of dust is generated. Further, since the brick lining and the solidified residual iron are hard and heavy, it is necessary to divide them into small components to convey them from the opening portion provided in the furnace bottom section. For the reasons mentioned above, the time required for the conventional scrapping operation has become very long and as a result, the operation is costly.

Further, an outrigger crane placed in a supporting column for maintenance may be used. In this case, the shell in the furnace bottom section of the blast furnace has been cut to form short strips having a weight of 5 to 50 tons and has been taken out by the outrigger crane, and the solidified residual iron is removed from the furnace through the opening portion provided in the furnace bottom section of the blast furnace.

Further, as another method, a method of revamping an inner portion of a blast furnace is disclosed in Japanese Unexamined Patent Publication Nos. 10-96005 and 7-197112. A method of scrapping a furnace bottom section of a blast furnace described in Japanese Patent Unexamined Publication No. 10-96005 is structured to cut a lower portion of the furnace, suspend and fix a furnace body of the blast furnace by a supporting column, thereafter scrap a shell in the lower portion of the furnace, horizontally cut solidified residual iron within the blast furnace with a wire saw and integrally take out the solidified residual iron. On the contrary, a method of conveying solidified residual iron in a furnace bottom section of a blast furnace out of the furnace described in Japanese Patent Unexamined Publication No. 7-197112 is structured to place a jack between a solidified residual iron in the periphery within the blast furnace and a furnace bottom section to lift up in a vertical direction, thereafter insert an object for reducing a coefficient of friction such as a cylinder or the like and take out the solidified residual iron.

However, the conventional methods of scrapping the furnace bottom section of the blast furnace have the following problems.

(1) In the method using the outrigger crane, since the solidified residual iron within the blast furnace is a large-size solidified residual iron having a weight of about 500 ton, while the suspending capacity of the outrigger crane is about 70 to 200 ton, it is necessary to divide the solidified residual iron into small pieces.

(2) In the method described in Japanese Patent Unexamined Publication No. 10-96005, a long time is required for the cutting operation of the brick and a lot of labor is required to remove the solidified residual iron.

(3) In the method described in Japanese Patent Unexamined Publication No. 7-197112, the size of the conveyed-out solidified residual iron is limited even when the coefficient of friction of the solidified residual iron and the furnace bottom section brick is reduced by using a cylinder or the like.

Further, since the supporting column for supporting the furnace body is provided in the outer periphery of the blast furnace, it is necessary to perform the operation not to interfere with the supporting column at the time of conveying the solidified residual iron out of the furnace whichever method is employed.

SUMMARY OF THE INVENTION

In accordance with the invention, there is provided a method of scrapping a furnace bottom section of a blast furnace comprising the steps of:

horizontally cutting a furnace body of the blast furnace after being blown out at a position higher than solidified residual iron left in the furnace bottom section;

suspending an upper frame body above the cutting position by employing vertically moving means placed in a supporting column;

taking out at least a part of a shell and a brick lining in a lower furnace body below the cutting position all around the periphery; and thereafter conveying the solidified residual iron out of the furnace, wherein the upper furnace body and the solidified residual iron are integrally connected by using a suspending device before conveying the solidified residual iron out of the furnace, and the upper furnace body and the solidified residual iron are vertically moved by using the vertical moving means.

In accordance with the invention mentioned above, it is preferable to make the structure such that a plurality of cavities are provided along a peripheral portion of the solidified residual iron and at a plurality of portions between the solidified residual iron and the furnace bottom brick before conveying the solidified residual iron out of the furnace, the solidified residual iron is jacked up by a lifting-up jack arranged in the cavity to form a gap between the solidified residual iron and the furnace bottom brick, a solidified residual iron suspending band (herein after referred to as "suspending band") is inserted into the gap. Thereafter, the upper furnace body suspended in the supporting column is lowered by using the vertical moving means so that the suspending band is connected to the suspending device fixed to a lower portion of the upper furnace body. Next, the upper furnace body is suspended together with the solidified residual iron by using the vertical moving means so that an operating space is formed between the solidified residual iron and the furnace bottom brick or a bottom plate of the blast furnace and a horizontally moving table is moved on the furnace bottom brick or the bottom plate of the blast furnace. Thereafter, the upper furnace body and the solidified residual iron are lowered by using the vertical moving means to be mounted on the horizontal moving table. Next, the suspending device fixed to the lower portion of the upper furnace body is separated. Thereafter, the upper furnace body is evacuated upwardly by using the vertical moving apparatus, and the horizontal moving table mounting the solidified residual iron thereon is moved from the inner portion of the furnace to the outer portion of the furnace.

Further, it is preferable to make the structure such that the suspending device is fixed to a tuyere of the upper furnace body.

Further, it is preferable to make the structure such that a surface layer portion of the furnace bottom brick is flattened under the operating space formed between the solidified residual iron and the furnace bottom brick, or the furnace bottom brick is removed. Thereafter, a furnace inner rail is placed on the furnace bottom brick or the bottom plate of the blast furnace, and the horizontal moving table is moved on the furnace inner rail.

Further, it is preferable to make the structure such that a surface layer portion of the furnace bottom brick is flattened under the operating space formed between the solidified residual iron and the furnace bottom brick, or the furnace bottom brick is removed. Thereafter, the horizontal moving table having a solidified residual iron receiving table detachably arranged in a plurality of through holes is moved onto the furnace brick or the bottom plate of the blast furnace, the upper furnace body and the solidified residual iron are descended by using the vertical moving means to be mounted on the solidified residual iron receiving table, a lower end surface of the solidified residual iron receiving table is grounded on the furnace bottom brick or the bottom plate of the blast furnace due to a deadweight of the solidified residual iron so that a construction space is formed between the horizontal moving table and the furnace bottom brick or the bottom plate of the blast furnace, and the furnace inner rail is placed on the furnace bottom brick or the bottom plate of the blast furnace under the construction space. Thereafter, the upper furnace body and the solidified residual iron are suspended by using the vertical moving means so that solidified residual iron receiving table is taken out from the horizontal moving table, and the upper furnace body and the solidified residual iron are lowered by using the vertical moving means to be mounted on the horizontal moving table. Next, the suspending device fixed to the lower end portion of the upper furnace body is separated. Thereafter, the upper furnace body is evacuated upwardly by using the vertical moving apparatus, and the horizontal moving table mounting the solidified residual iron thereon is moved to the outer portion of the furnace from the inner portion of the furnace.

Further, it is preferable to make the structure such that a receiving shelf is provided in a through hole provided in the horizontal moving table. The solidified residual iron receiving table is supported with respect to the receiving shelf via a plurality of springs by a bracket provided on an upper side surface thereof. A lower end surface of the solidified residual iron receiving table is moved apart from the furnace bottom brick or the bottom plate of the blast furnace due to elastic force of the spring when the horizontal moving table is moved onto the furnace bottom brick or the bottom plate of the blast furnace. The spring is compressed via the bracket when the solidified residual iron is mounted on the solidified residual iron receiving table so that the lower end surface of the solidified residual iron receiving table is grounded on the furnace bottom brick or the bottom plate of the blast furnace, and the construction space is formed between the horizontal moving table and the furnace bottom brick or the bottom plate of the blast furnace.

Further, it is preferable to make the structure such that the horizontal moving table arranged on the furnace inner rail is moved via a roller or a slide shoe arranged in a lower portion of the horizontally moving table.

Further, it is preferable to make the structure such that the slide shoe is arranged within a groove formed in the furnace inner rail, a friction coefficient reducing member is interposed between the slide shoe and the groove formed in the furnace inner rail, and the horizontal moving table is moved due to sliding motion along the groove formed in the furnace inner rail of the slide shoe.

Further, it is preferable to make the structure such that the friction coefficient reducing member is made of Teflon® and/or stainless steel.

Further, it is preferable to make the structure such that the shape of the suspending band is formed in a Y shape.

Further, it is preferable to make the structure such that the shape of the suspending band is formed in a web shape, and the solidified residual iron is suspended by crossing two web-like suspending bands to form an X shape.

Further, it is preferable to make the structure such that the solidified residual iron is separated to be suspended together with the upper furnace body by using the vertical moving means.

Further, it is preferable to make the structure such that the solidified residual iron mounted on the horizontal moving table is separated.

Further, it is preferable to make the structure such that a beam is arranged within the upper furnace body, the beam and the solidified residual iron are connected by using the suspending member, and the solidified residual iron is suspended by using the suspending member and the suspending band.

BRIEF DESCRIPTION OF THE DRAWINGS

FIGS. 34A and 34B are cross sectional views showing an embodiment of another structure of the solidified residual iron receiving table provided in the horizontal moving table, in which FIG. 34A is a cross sectional view showing the state in which the solidified residual iron is not mounted and FIG. 34B is a cross sectional view showing the state in which a spacer is taken out and the solidified residual iron is mounted.

DESCRIPTION OF THE INVENTION

A description will be given of a method of scrapping a furnace bottom section of a blast furnace in accordance with the present invention in correspondence to steps thereof.

Figure 1:
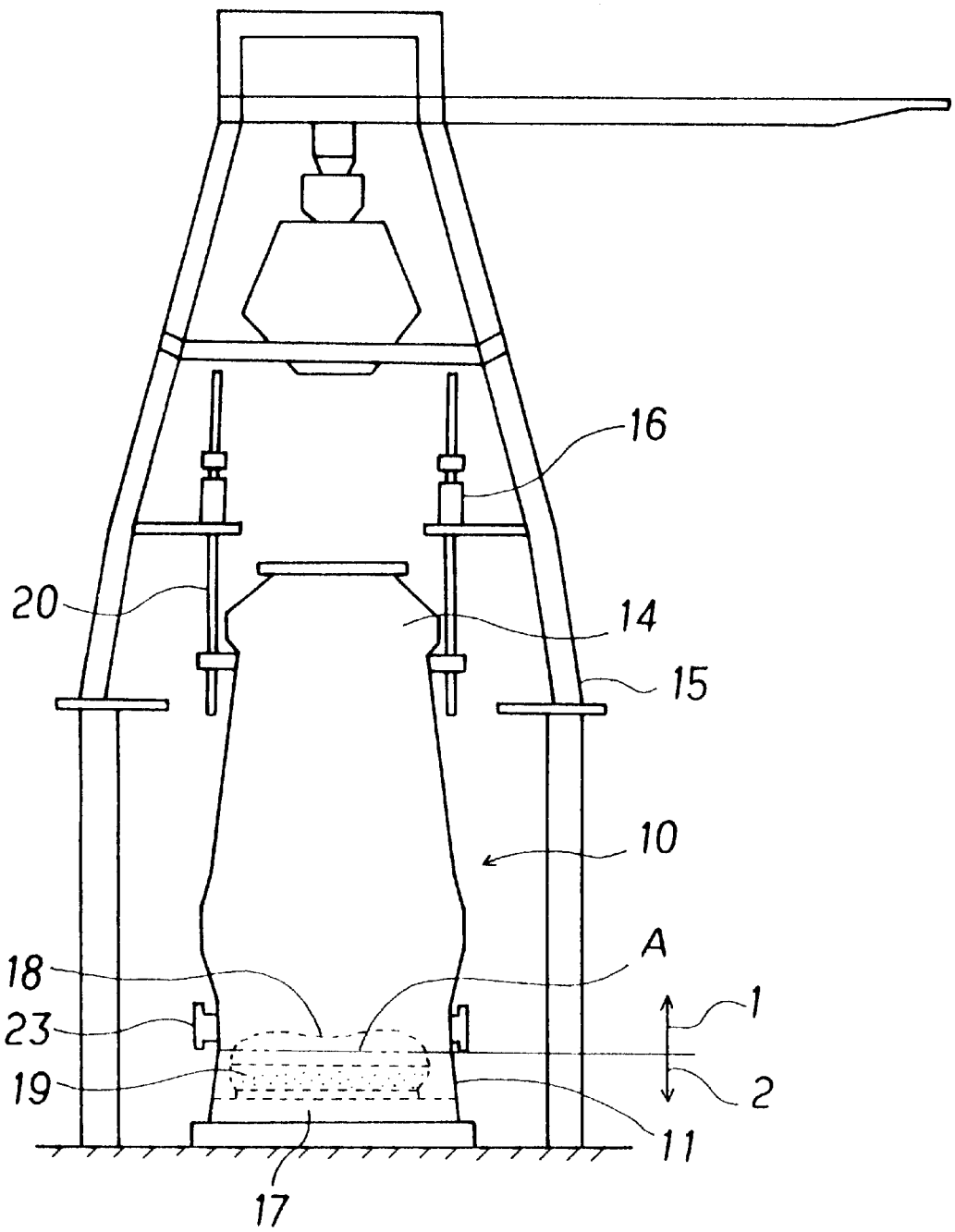
FIG. 1 is a front elevational view of a blast furnace.

As shown in FIG. 1, the structure is made such that a blast furnace 10 is covered with a shell outer side, a stave for cooling is attached to an inner side of the shell, and a brick layer constituted by a fire brick or the like is provided in an inner side of the stave. A connecting portion of the shell is adhered by welding. A supporting column 15 for use in revamping or the like is assembled on an outer side of the blast furnace 10, and a plurality of lift jacks 16 corresponding to an embodiment of vertical moving means are placed in an upper portion of the supporting column 15. The lift jack 16 is employed in the case of assembling the shells divided into a plurality of portions (for example, four) in a vertical direction within the supporting column 15 at a time of installing a new furnace body. In accordance with the invention, the lift jack 16 is utilized for a scrapping operation of a furnace bottom section 11.

A furnace bottom brick (normally using a carbon brick) 17 exists in a lowermost portion of the furnace bottom section 11 of the blown out blast furnace 10, a solidified residual iron 19 in which a slug and a coke are mixed and solidified to pig iron exists on the furnace bottom brick 17, and collapsible solidified material 18 in which a mixture of the coke, the slug and the like is melted and solidified exists thereon. In order to revamp the furnace bottom brick 17, it is necessary to remove the collapsible solidified material 18 and the solidified residual iron 19. In this case, in the present embodiment, a description will be given of the case of crushing the collapsible solidified material 18 to remove by using construction machinery such as a bulldozer or the like and thereafter suspending the solidified residual iron 19 to remove from the furnace bottom section 11.

When scrapping the furnace bottom section 11 of the blown out blast furnace 10, at first, a front end portion of a rod 20 suspended from a lift jack 16 placed in the supporting column 15 in such a manner as to freely move vertically is fixed to a top section 14 to support the blast furnace 10. Next, the shell of the furnace bottom section 11 is horizontally cut and the shell of the lower furnace body 2 and the lining brick disposed below a cutting position A are taken out. The cutting height is set to be at least higher than the solidified residual iron 19 left in the furnace bottom section 11. When the shell of the lower furnace body 2 of the blast furnace 10 is taken out, the upper furnace body 1 disposed above the cutting position A of the shell is suspended by the lift jack 16 placed in the supporting column 15.

Figure 2:
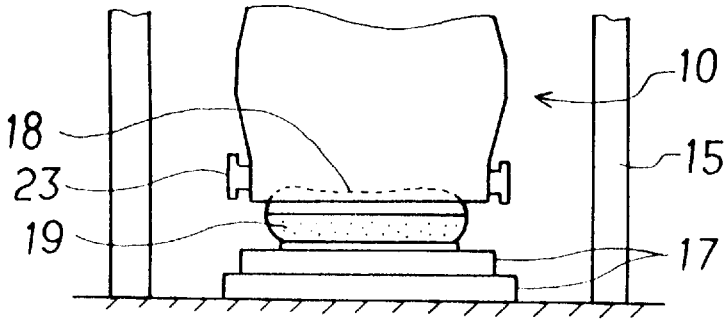
FIG. 2 is a front elevational view showing the state of a furnace bottom section when taking out a shell in the furnace bottom section.

As shown in FIG. 2, the brick existing within the blast furnace 10 released by taking out the shell in the lower portion is crushed and removed by construction machinery (not shown). Among furnace inner residues on the furnace bottom brick 17, the collapsible solidified material 18 such as coke, the slug and the like which can be easily collapsed is conveyed out of the furnace by the construction machinery. Among the furnace inner residues, the solidified residual iron 19 which is difficult to crush has a weight of 300 to 500 tons. In the blast furnace 10 having a long service life, an erosion area of the furnace bottom brick 17 expands to a lower portion from an outlet port, and a part of the solidified residual iron 19 left in the erosion area is cooled during operation of the blast furnace to be solidified and exists in a state of replacing the furnace bottom brick 17.

Accordingly, the diameter of the solidified residual iron 19 is substantially close to the diameter of the furnace floor, and in a blast furnace in a class of 5000 $m^3$, it is necessary to convey out a large-size lump having a volume of 250 $m^3$ and a weight of 1300 tons. The solidified residual iron 19 is difficult to crush by the construction machinery, and there is no way except by blasting with dynamite. However, a long time is required for the blasting operation as mentioned above.

Figure 3:
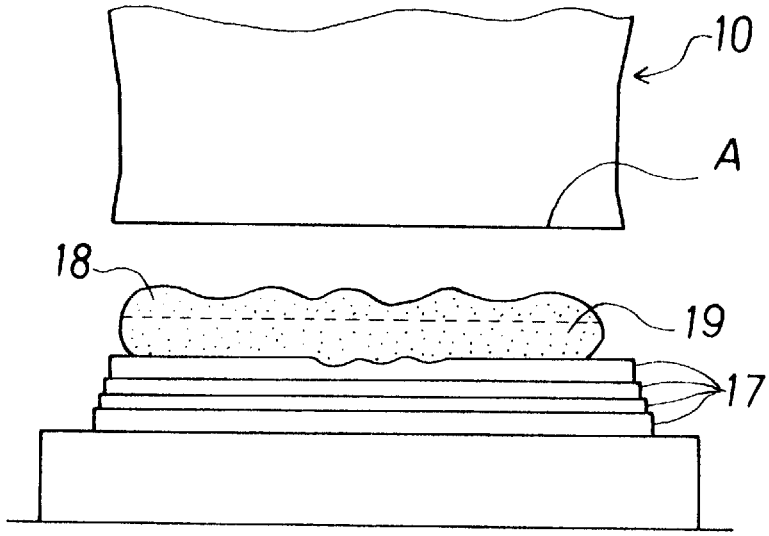
FIG. 3 is a front elevational view showing the state of a collapsible solidified material and a solidified residual iron when taking out the shell in the furnace bottom section.
Figure 4:
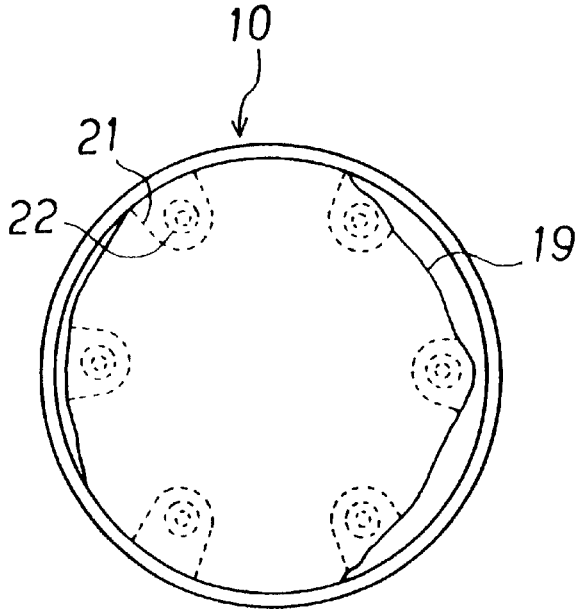
FIG. 4 is a plan view showing the state of arranging a lifting jack in a cavity in the periphery of the solidified residual iron.
Figure 5:
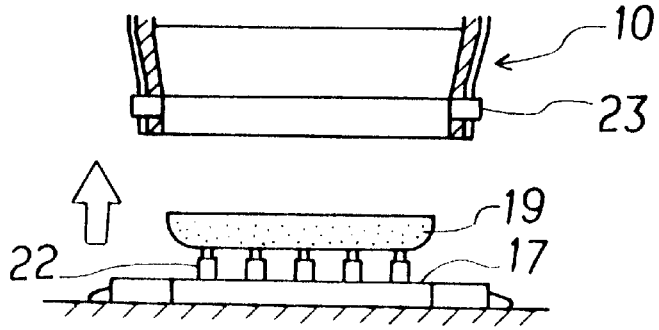
FIG. 5 is a cross sectional view showing the state of jacking the solidified residual iron by the lifting jack.

As shown in FIG. 3, the solidified residual iron 19 exists on the furnace bottom brick 17. The collapsible solidified material 18 is removed. Thereafter, as shown in FIG. 4, a plurality of cavities 21 are provided at a plurality of portions in the periphery of the solidified residual iron 19 from a surface of the furnace bottom brick 17, and lifting-up jack 22 is placed in a gap between the solidified residual iron 19 and the furnace bottom brick 17 in a portion of the cavity 21. The cavity 21 can be easily excavated, for example, by a shovel car or the like. Next, as shown in FIG. 5, the solidified residual iron 19 is jacked up in the direction of the arow by the lifting-up jack 22. An excavating operation of the cavity 21 and the jacking-up operation of the solidified residual iron 19 by the lifting-up jack 22 mentioned above can be performed at a temperature of about 300° C. without cooling the solidified residual iron 19 to room temperature. Accordingly, it is possible to start the removing operation of the solidified residual iron 19 after blowing out the blast furnace 10.

Figure 6:
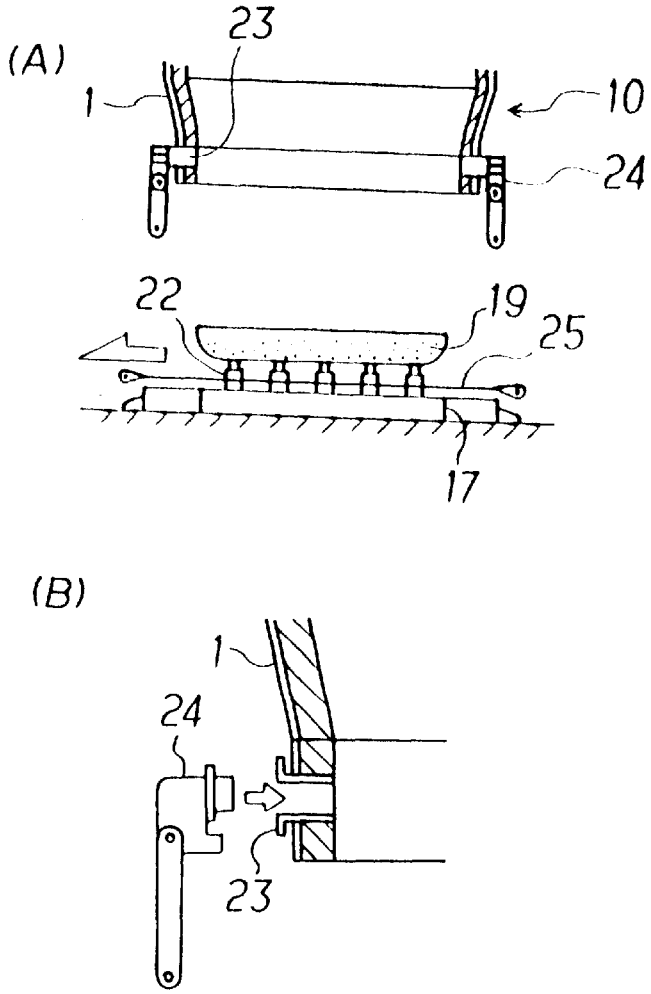
FIG. 6A is a cross sectional view showing the state in which a suspending band is inserted between the solidified residual iron lifted up by the lifting jack and a furnace bottom brick.
FIG. 6B is a partly enlarged cross sectional view showing a state in which a suspending device is attached to a tuyere.
Figure 7:
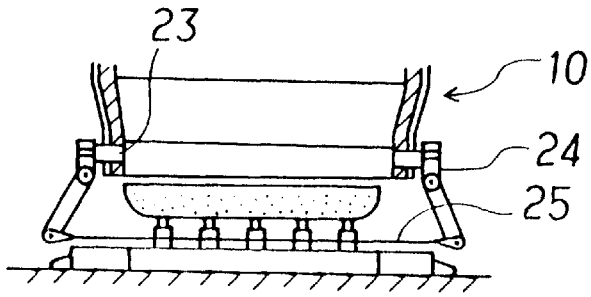
FIG. 7 is a front elevational view showing the state in which the suspended upper furnace body is descended and the suspending band is connected to the suspending device fixed to the tuyere.
Figure 8:
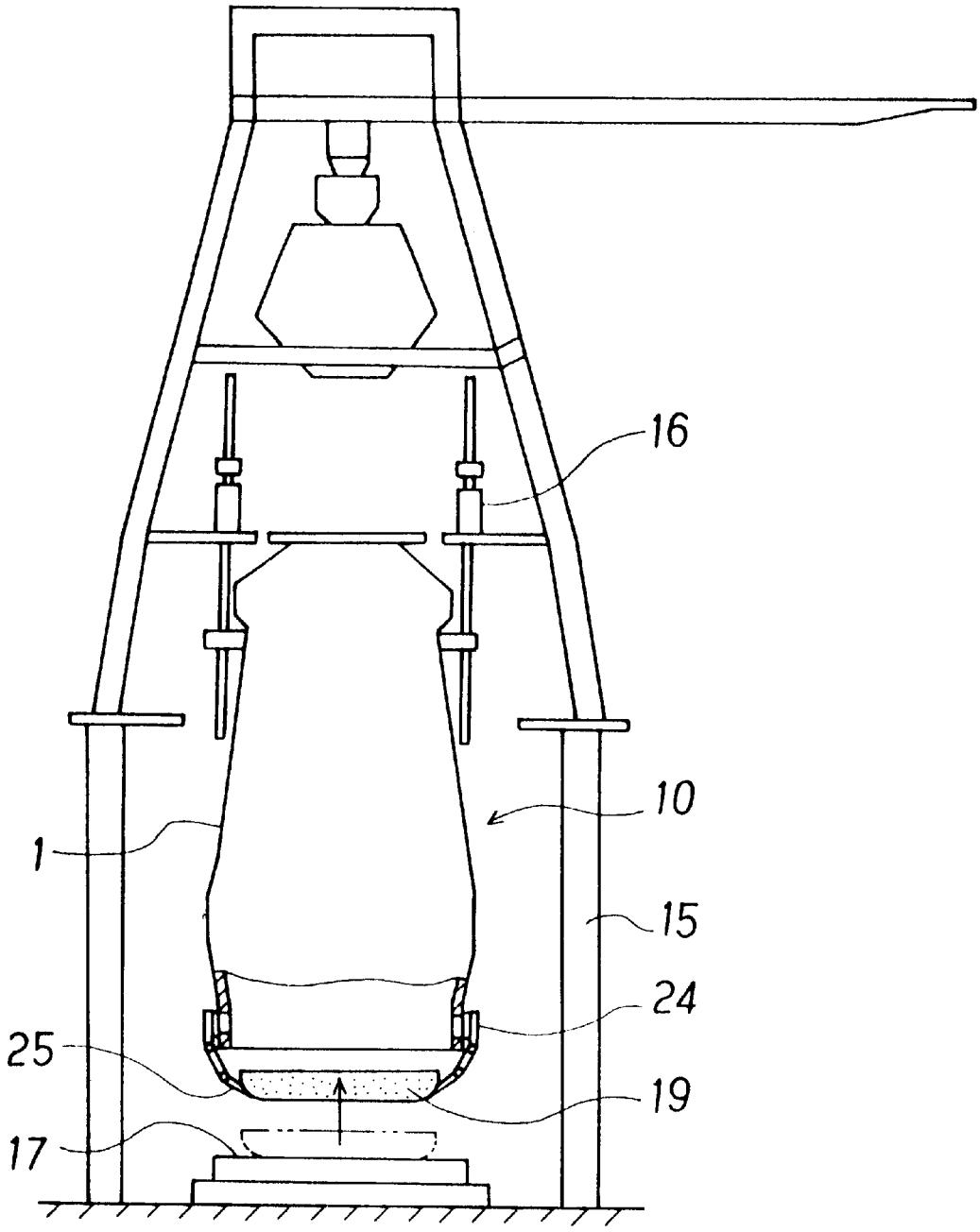
FIG. 8 is a front elevational view showing the state in which the upper furnace body is ascended by a lift jack, the solidified residual iron is suspended by using the suspending device and the suspending band and an operating space is formed above the furnace bottom brick.

Next, as shown in FIGS. 6A and 6B, a suspending device 24 is inserted and fixed to a tuyere 23 arranged in a lower portion of the suspended upper furnace body 1. On the contrary, a suspending band 25 (for example, having a width of 1200 mm and a thickness of about 25 to 50 mm) made of a steel sheet is inserted and extended to a gap between the solidified residual iron 19 and the furnace bottom brick 17 in the direction shown by the arrow. As shown in FIG. 7, after the upper furnace body 1 of the suspended blast furnace 10 is lowered by the lift jack 16, the suspending band 25 is connected to the suspending device 24. Next, as shown in FIG. 8, the upper furnace body 1 is lifted by the lift jack 16, the solidified residual iron 19 is suspended by the suspending device 24 and the suspending band 25, and the operating space is formed between the solidified residual iron 19 and the furnace bottom brick 17.

Figure 9:
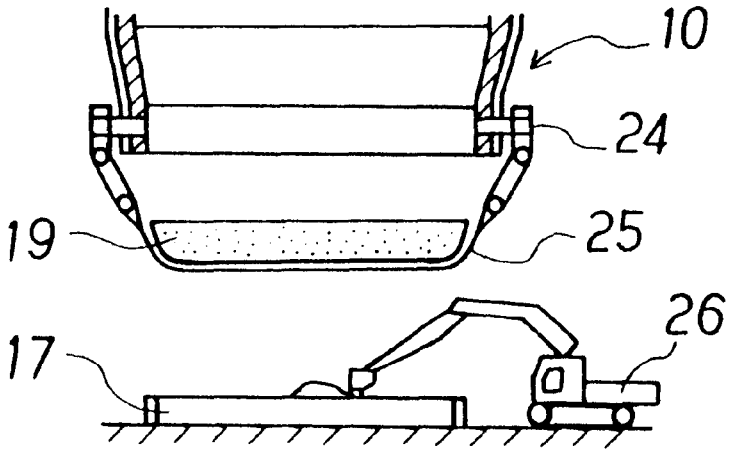
FIG. 9 is a front elevational view showing the state in which a surface layer portion of the furnace bottom brick is flattened by a construction machinery.
Figure 10:
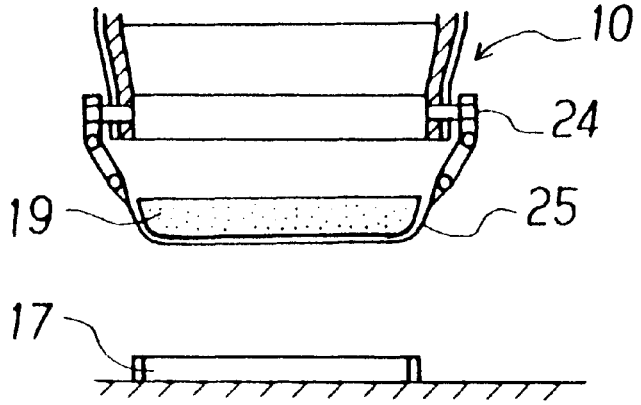
FIG. 10 is a cross sectional view showing a state after the surface layer portion of the furnace bottom brick is flattened.
Figure 11:
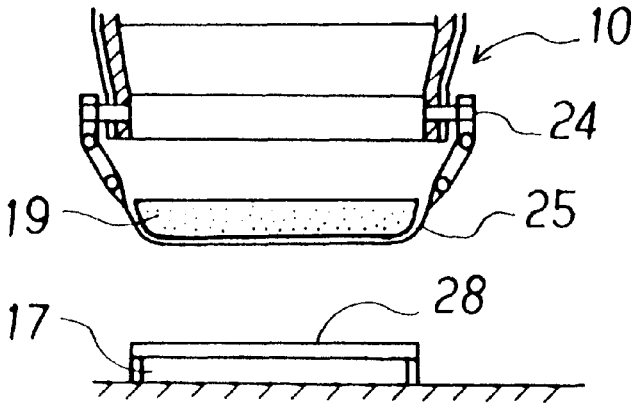
FIG. 11 is a cross sectional view showing the state in which a furnace inner rail is placed on a surface of the furnace bottom brick.
Figure 12:
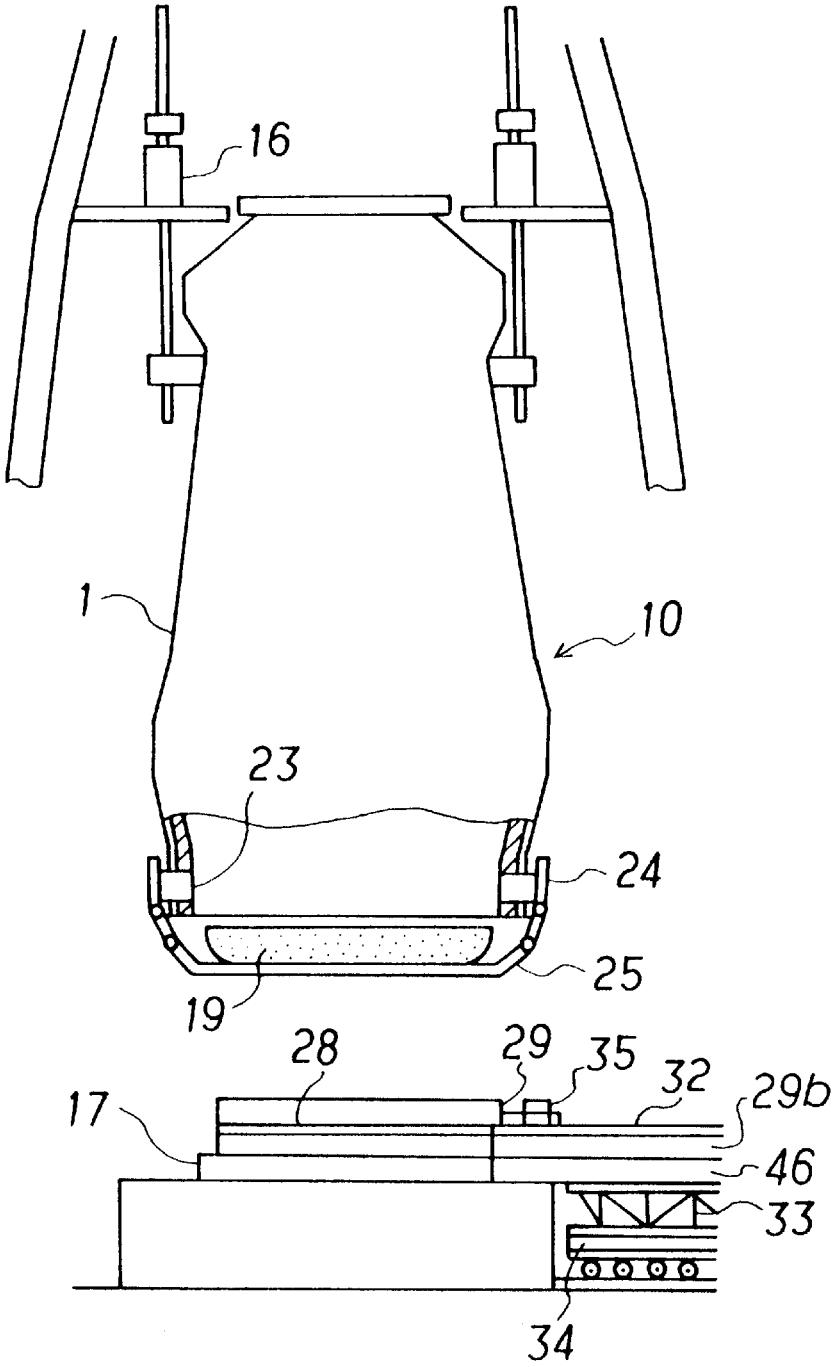
FIG. 12 is a front elevational view showing the state in which a horizontal moving table is moved onto the furnace inner rail.
Figure 13:
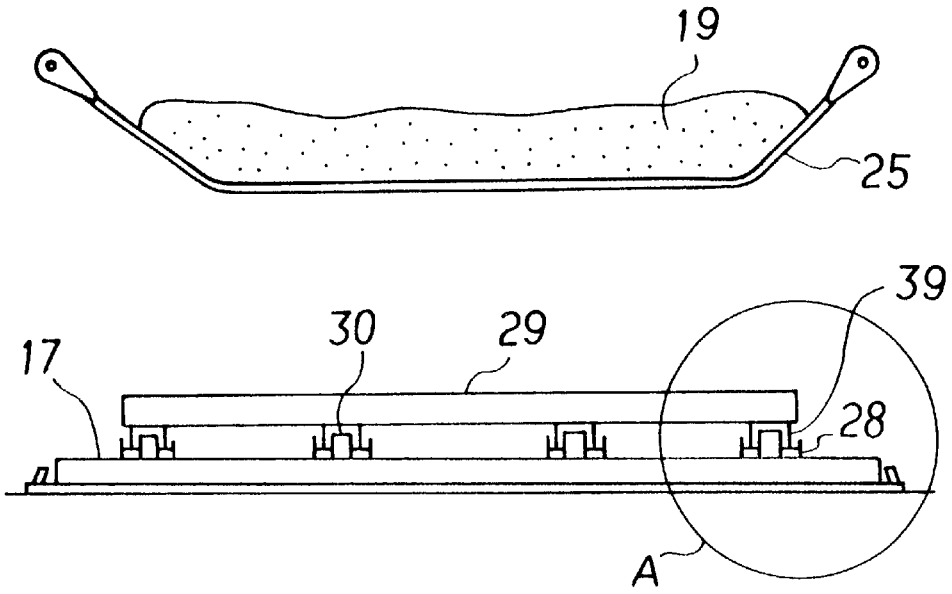
FIG. 13 is a side elevational view showing the state in which a roller structure body provided in a lower portion of the horizontal moving table is arranged in correspondence to a groove-type furnace inner rail.
Figure 14:
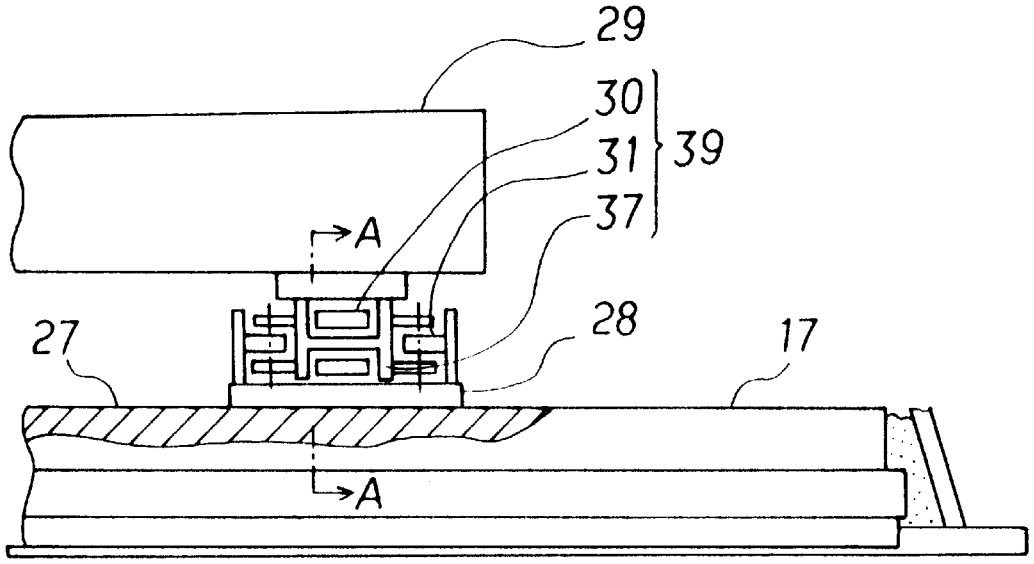
FIG. 14 is a side elevational view showing the state in which a roller structure body constituted by a guide roller and a moving roller provided in the lower portion of the horizontal moving table is arranged in correspondence to the groove type furnace inner rail.
Figure 15:
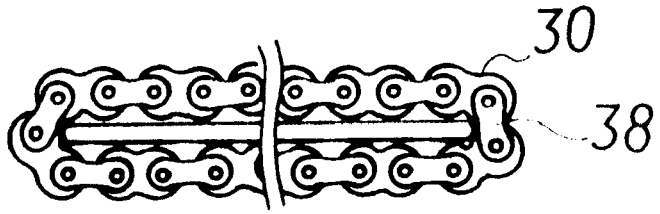
FIG. 15 is a front elevational view showing a multiplicity of moving rollers connected by an endless chain.

An operator 56 places a furnace inner rail 28 used for traveling a horizontal moving table 29 on a surface of the furnace bottom brick 17 as shown in FIG. 11 after forming a surface layer portion of the furnace bottom brick 17 in a flat surface with no unevenness as shown in FIGS. 9 and 10, under this operating space. Otherwise, the furnace bottom brick 17 is removed and the furnace inner rail 28 may be placed on the bottom plate of the blast furnace. As shown in FIG. 12, the horizontal moving table 29 can be easily taken onto the furnace inner rail 28 by using a winch or the like. It is preferable that the horizontal moving table 29 uses a truck provided with a moving roller 30 and a guide roller 31 in a lower portion thereof for being easily moved, for example, as shown in FIGS. 13 to 15. A pair of supporting frames 37 are provided on a lower surface of the horizontal moving table 29, a multiplicity of moving rollers 30 connected by an endless chain 38 are provided between these supporting frames 37, and a roller structure body 39 having a guide roller 31 arranged is provided in an outer surface side of the supporting frames 37. The roller structure body 39 employs a roller structure body on the market, is mounted in the lower portion of the horizontal moving table 29 at an interval (for example, in four lines), and is structured to move along the groove type furnace inner rail 28.

In this case, since the furnace inner rail 28 is placed in the furnace bottom brick 17 in which the surface layer portion is formed on a flat surface, or is placed on the bottom plate of the blast furnace by removing all of the furnace bottom brick 17, it is possible to receive a great weight. When a recess portion is partly provided in the furnace bottom brick 17, no problem is generated by charging the recess portion with mortar to form a flat surface and placing the furnace inner rail 28.

Figure 16:
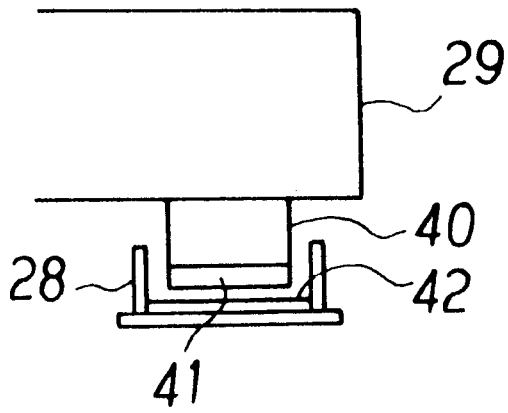
FIG. 16 is a side elevational view showing the state in which a slide shoe arranged on a lower surface of the horizontal moving table is arranged in correspondence to the groove type rail.
Figure 17:
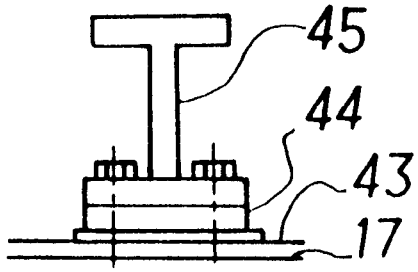
FIG. 17 is a side elevational view showing an I-type rail placed on the furnace bottom brick.

Further, the horizontal moving table 29 may be set on a slide truck, as shown in FIG. 16, structured such that the slide shoe 40 is arranged in the lower portion thereof and the slide shoe 40 is slid along the groove type furnace inner rail 28. A Teflon® foot 41 is adhered to a lower surface of the slide shoe 40 and a stainless steel plate 42 is attached to an upper surface of a groove portion in the furnace inner rail 28 to make the coefficient of friction small. Otherwise, as shown in FIG. 17, the structure may be made such that an I-type rail 45 is placed on a flat plate 43 provided on the furnace bottom brick 17 via a level adjusting liner 44 and a truck having wheels is moved thereon, or the structure may be made such that a slide truck is placed on the I-type rail 45 and is slid by employing a lubricating oil, a cleaning material, a soap or the like. In this case, it is important to structure a moving structure for the horizontally moving table 29 which can reduce a coefficient of friction at a low cost and has an improved operability.

Figure 18:
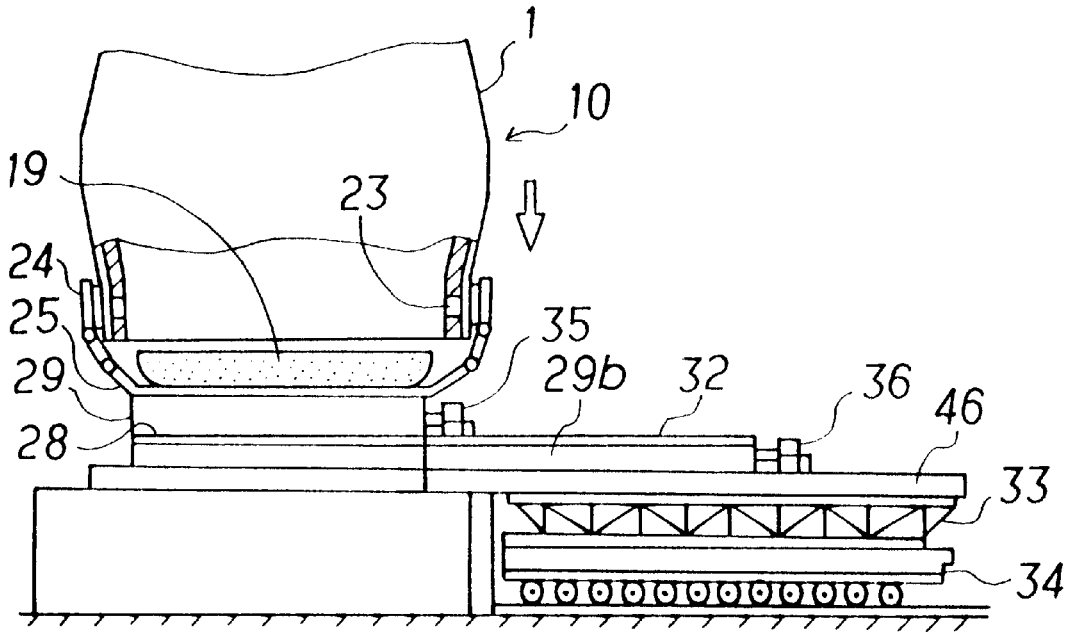
FIG. 18 is a front elevational view showing the state in which the upper furnace body is descended by a lift jack and the solidified residual iron supported via the suspending band is mounted on the horizontal moving table.
Figure 19:
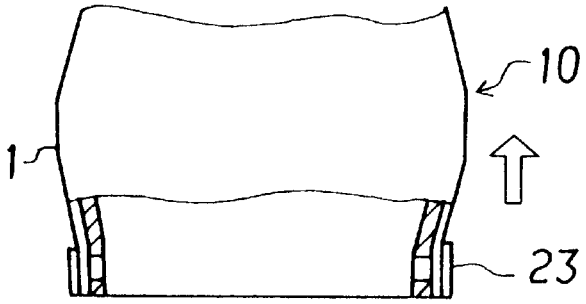
FIG. 19 is a front elevational view showing the state in which the upper furnace body is evacuated by being ascended by the lift jack and the horizontal moving table mounting the solidified residual iron thereon is moved to a furnace body transferring truck.
Figure 19:
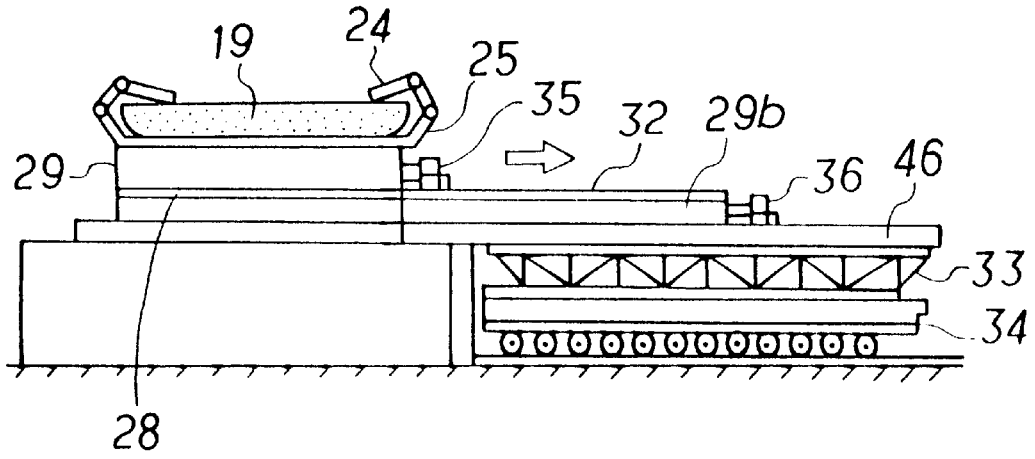

Next, as shown in FIG. 18, the upper furnace body 1 of the blast furnace 10 is descended by the lift jack 16, and the solidified residual iron 19 supported via the suspended device 24 and the suspending band 25 is mounted on the horizontally moving table 29. After separating the suspending device 24 from the tuyere 23, the upper furnace body 1 of the blast furnace 10 is suspended by the lift jack 16 to be evacuated upward, as shown in FIG. 19. The suspending device 24 and the suspending band 25 used for suspending up the solidified residual iron 19 are kept being mounted on the horizontally moving table 29 together with the solidified residual iron 19. A rack rail 32 is placed on a moving truck 29*b* to be connected to the furnace inner rail 28, and the horizontally moving table 29 mounting the solidified residual iron 19 thereon can move toward a furnace body transferring truck 34 provided with an accumulating level adjusting structure 33 and a leveling block 46.

Figure 20:
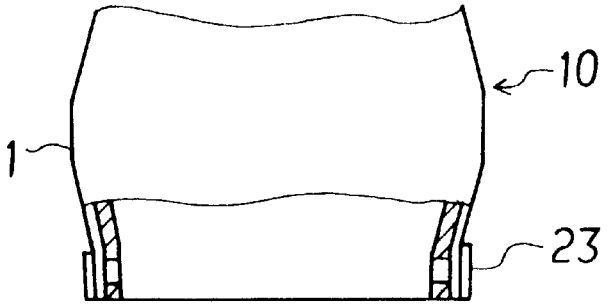
FIG. 20 is a front elevational view showing the state in which the horizontal moving table mounting the solidified residual iron thereon is moved onto a rack rail by operating a cylinder for moving arranged near the rack rail.
Figure 20:
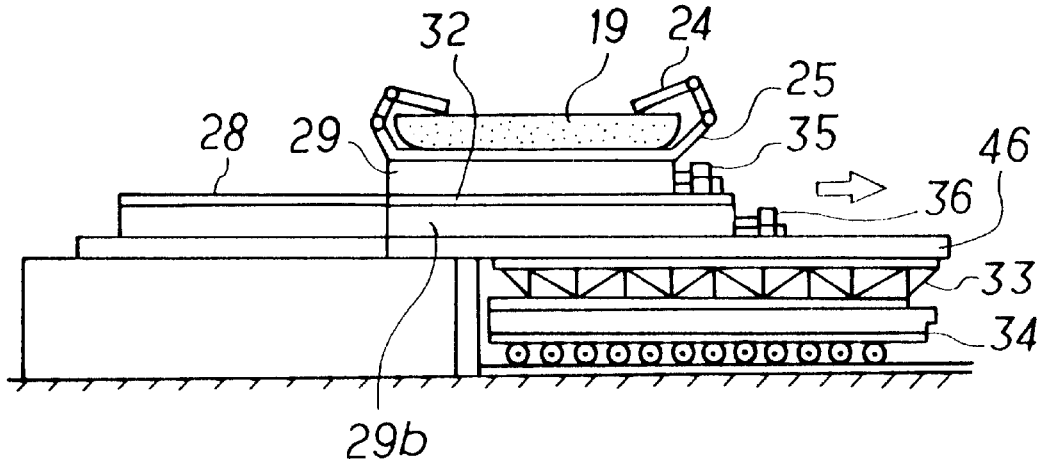

As shown in FIGS. 19 and 20, the solidified residual iron 19 is taken out from the inner furnace to the outer furnace by moving the horizontally moving table 29 mounting the solidified residual iron 19 thereon onto the rack rail 32 from the furnace inner rail 28 while changing a fixing position of the cylinder for moving 35 arranged near the rack rail 32 forward at every one stroke operation. An embodiment of a mechanism for moving the horizontally moving table 29 by using the cylinder for moving 35 will be shown in FIGS. 28 and 29. A method of operating the mechanism will be later described in detail in combination with a description of FIGS. 28 and 29.

Figure 21:
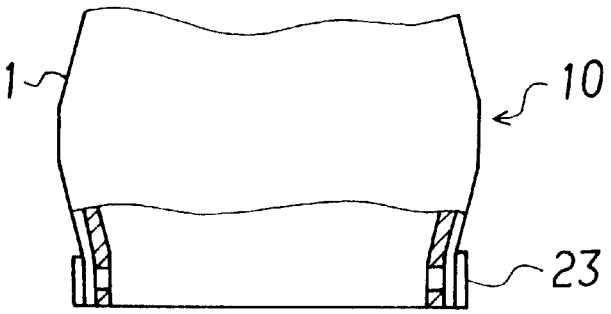
FIG. 21 is a front elevational view showing the state in which the horizontally moving table mounting the solidified residual iron thereon is mounted on an accumulating level adjusting structure of the furnace body transferring truck.
Figure 21:
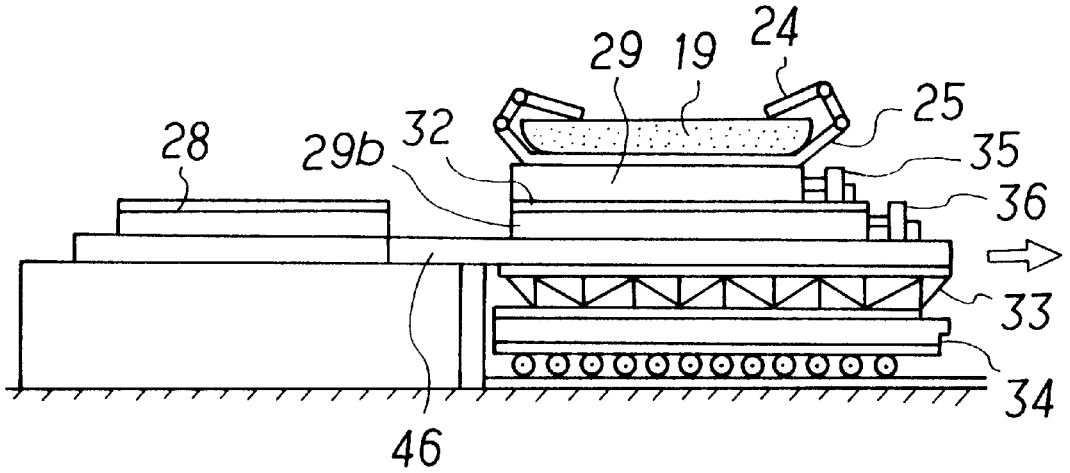

Next, the moving truck 29*b* is moved onto the furnace body transferring truck 34 by operating the cylinder for moving 36 arranged on the furnace body transferring truck 34, as shown in FIG. 21. In the manner mentioned above, the solidified residual iron 19 is mounted on the accumulating level adjusting structure 33 of the furnace body transferring truck 34 together with the horizontal moving table 29 on the rack rail 32 placed on the moving truck 29*b*. Subsequently, the furnace body transferring truck 34 is moved to a solidified residual iron storage space and a series of scrapping operations of the furnace bottom section of the blast furnace is finished.

Figure 22:
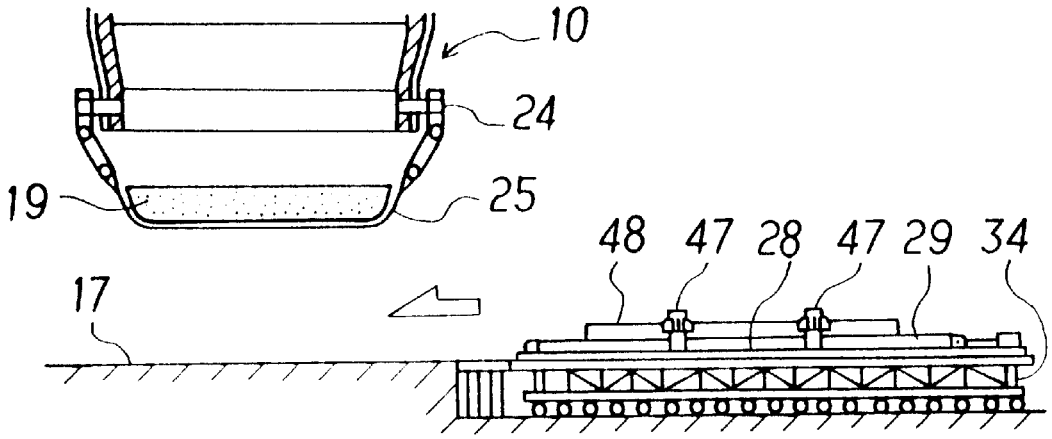
FIG. 22 is a front elevational view showing the state in which the furnace body transferring truck supporting the horizontal moving table having the solidified residual iron receiving table thereon waits near the furnace bottom section of a blast furnace.
Figure 23:
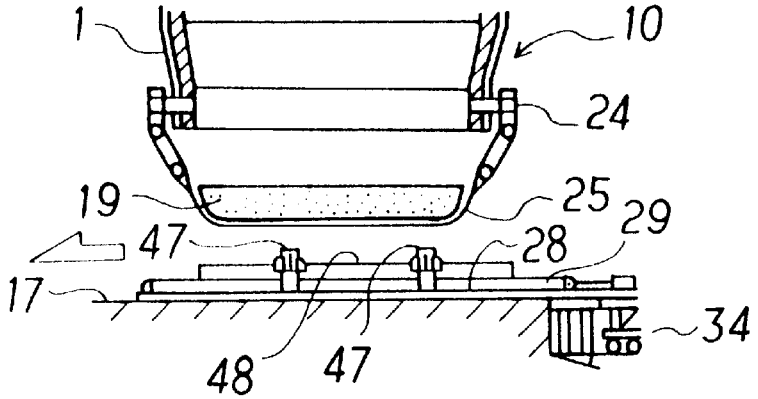
FIG. 23 is a front elevational view showing the state in which the horizontal moving table is moved within the furnace from the furnace body transferring truck by suspending up the solidified residual iron.

In this case, in accordance with the present invention, it is possible to use the horizontal moving table 29 having a solidified residual iron receiving table 47 as shown in FIG. 22. That is, the horizontal moving table 29 holds the furnace inner rail 28 to the lower portion thereof by a bolt or the like when waiting near the furnace bottom portion 11. Further, as shown in FIG. 23, the horizontal moving table 29 moves onto the furnace bottom brick 17 together with the furnace inner rail 28 in a state of suspending the solidified residual iron 19. At this time, the horizontal moving table 29 easily moves onto the furnace bottom brick 17 from the furnace body transferring truck 34 by a roller or the like attached to the lower surface of the furnace inner rail 28.

Figure 24:
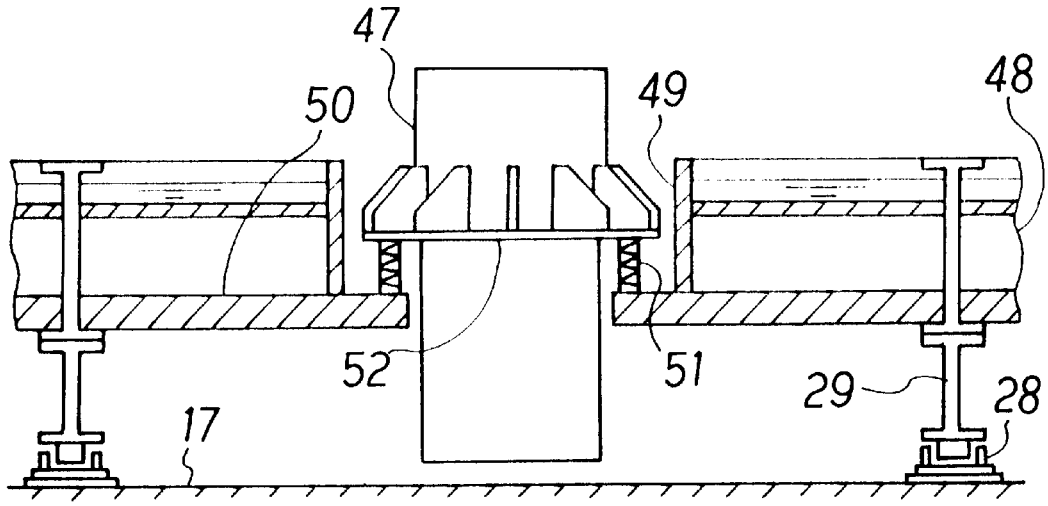
FIG. 24 is a cross sectional view showing the structure of the solidified residual iron receiving table provided in the horizontal moving table.

A plurality of (for example, four) through holes 49 extending in a vertical direction are provided in the solidified residual iron receiving portion 48 on the horizontal moving table 29, and a solidified residual iron receiving table 47 (having a height of about 2.8 m) is detachably arranged in each of the through holes 49. Further, a receiving shelf 50 is arranged at a position corresponding to a middle portion in the height direction of the support of the solidified residual iron receiving table 47 within the through hole 49, as shown in FIG. 24. The solidified residual iron receiving table 47 is supported by a bracket 52 provided on a side surface there of via a plurality of springs 51 arranged on the receiving shelf 50. When the horizontal moving table 29 waits near the furnace bottom section 11, that is, when the solidified residual iron 19 is not mounted on the solidified residual iron receiving table 47, the lower end surface of the solidified residual iron receiving table 47 moves apart from the furnace bottom brick 17 due to the elastic force of the spring 51, so that it is possible to move the horizontal moving table 29 onto the furnace bottom brick 17 from the outer portion of the furnace.

Figure 25:
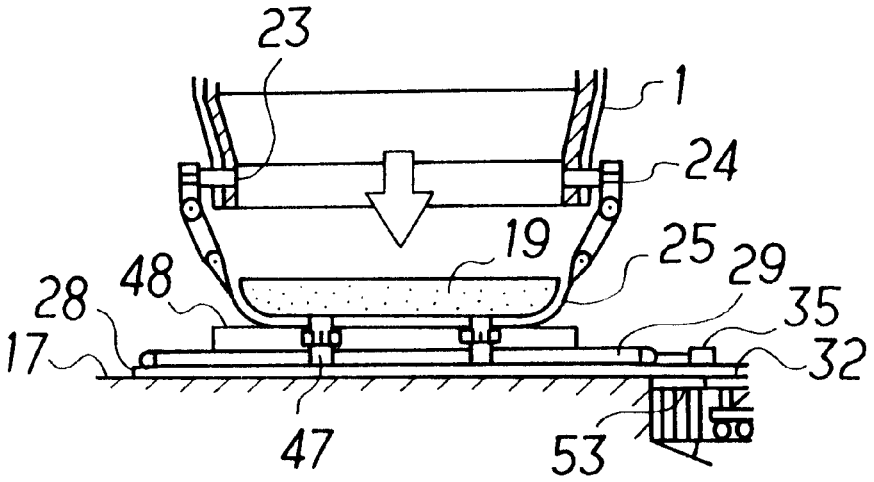
FIG. 25 is a front elevational view showing the state in which the upper furnace body is lowered by the lift jack and the solidified residual iron supported via the suspending band is mounted on the solidified residual iron receiving table.
Figure 26:
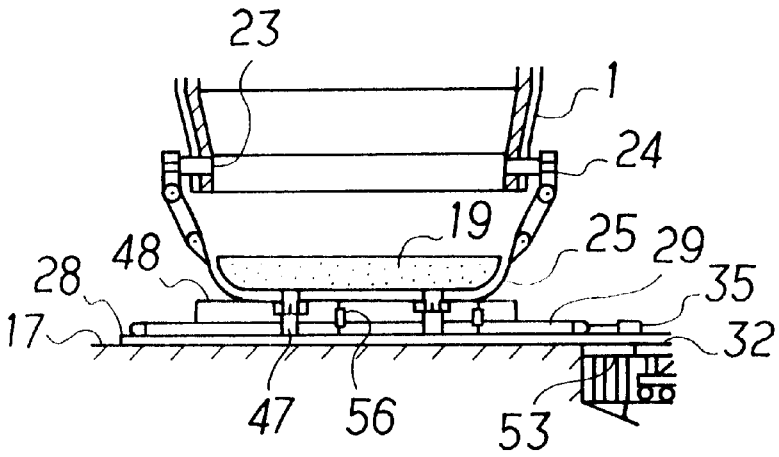
FIG. 26 is a front elevational view showing the state in which the solidified residual iron is mounted on the solidified residual iron receiving table and the furnace inner rail is placed on the furnace bottom brick.

Prior to moving the horizontal moving table 29 onto the furnace bottom brick 17, the operating space is formed between the solidified residual iron 19 and the furnace bottom brick 17 as mentioned above, and the operator 56 forms the surface layer portion of the furnace bottom brick 17 in a flat shape under the operating space. After moving the horizontal moving table 29 onto the furnace bottom brick 17, the upper furnace body 1 is descended by the lift jack 16 and the supported solidified residual iron 19 is mounted on the receiving table 47 by using the suspending device 24 and the suspending band 25, as shown in FIG. 25. The spring 51 is compressed via the bracket 52 due to a deadweight of the solidified residual iron 19, and the lower end surface of the solidified residual iron receiving table 47 is grounded on the furnace bottom brick 17. Accordingly, a construction space is formed between the horizontal moving table 29 and the furnace bottom brick 17. As shown in FIG. 26, the operator 56 applies a placing construction of the furnace inner rail 28 on the furnace bottom brick 17 under the construction space, that is, applies a placing construction constituted by charging the lower side of the furnace inner rail 28 with grout material and aligning the level of the furnace inner rail 28 so as to fix it in the selected position.

Otherwise, all of the furnace bottom bricks 17 are removed and the furnace inner rail 28 may be placed in the bottom plate of the blast furnace.

The furnace inner rail 28 is connected to the rack rail 32 placed on the furnace body transferring truck 34 via a furnace outer rail 53.

Figure 27:
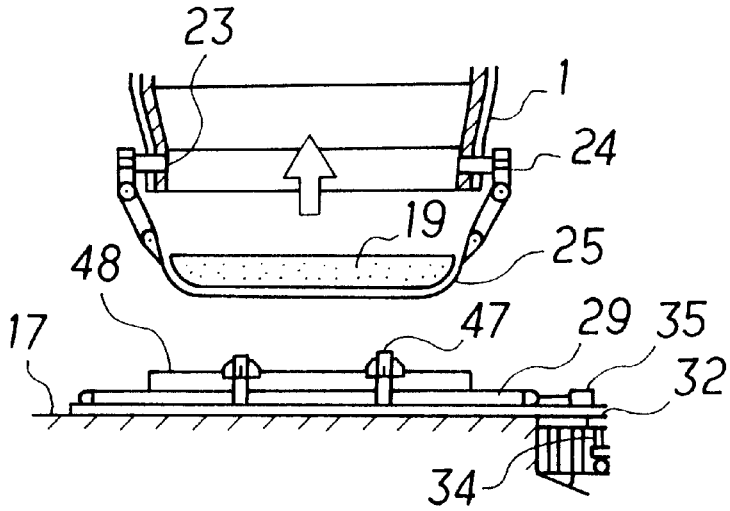
FIG. 27 is a front elevational view showing the state in which the upper furnace body is lifted by the lift jack and the solidified residual iron is suspended from the solidified residual iron receiving table by using the suspending device and the suspending band.

Next, as shown in FIG. 27, the upper furnace body 1 is suspended by the lift jack 16 and the solidified residual iron 19 is moved upwardly from the solidified residual iron receiving table 47. In this case, since the solidified residual iron receiving table 47 is not required, the solidified residual iron receiving table 47 is taken out from the through hole 49. In the case that it is hard to take out within the furnace, the horizontal moving table 29 is taken out onto the rack rail 32 placed in the furnace body transferring truck 34 by using the cylinder for moving 35 to be taken out.

Figure 34:
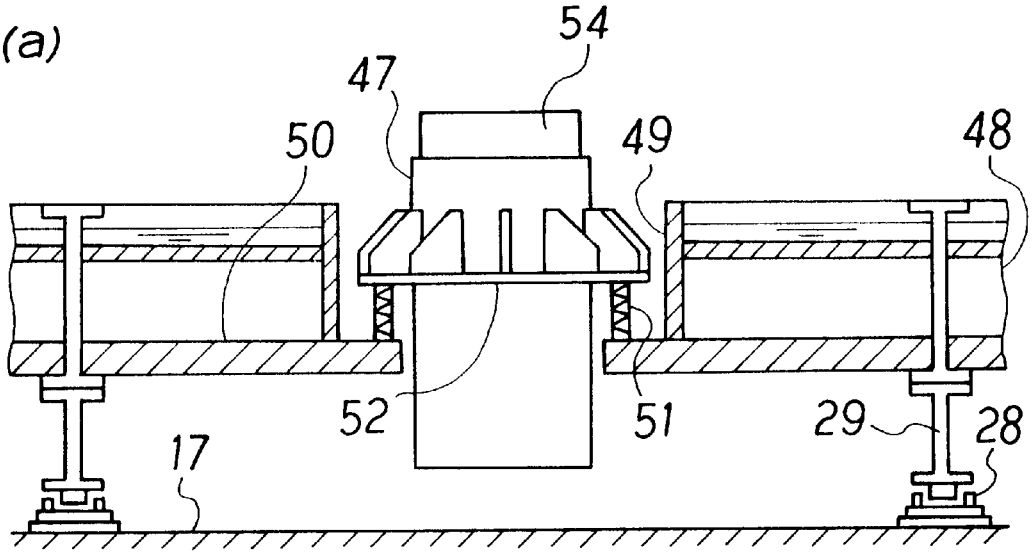
Figure 34:
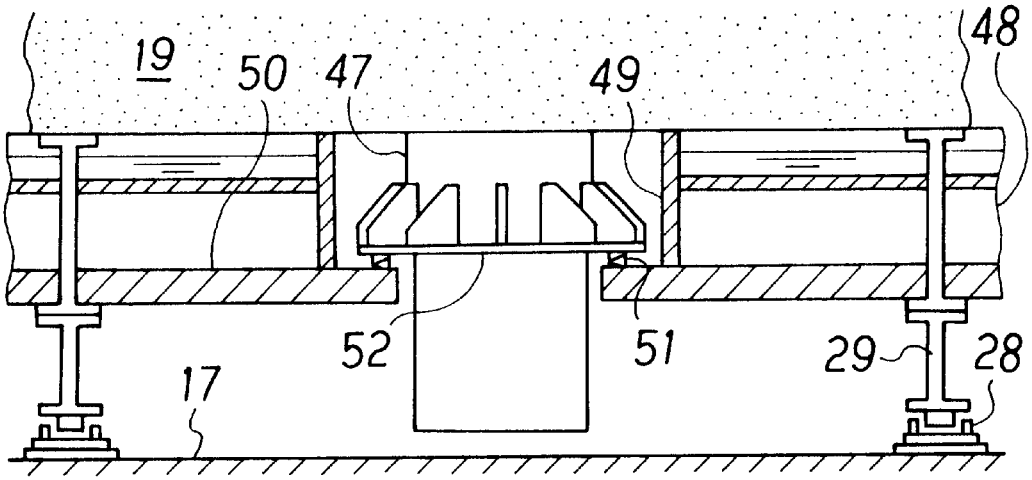

Otherwise, as shown in FIG. 34A, the spacer 54 can be arranged and used on the upper surface of the solidified residual iron receiving table 47. That is, at the time of performing the placing construction of the furnace inner rail 28, the solidified residual iron 19 is mounted on the spacer 54. The lower end surface of the solidified residual iron receiving table 47 is grounded on the furnace bottom brick 17 due to the deadweight of the solidified residual iron 19. Accordingly, the construction space is formed between the horizontal moving table 29 and the furnace bottom brick 17.

After construction of the furnace inner rail 28 is finished, the solidified residual iron 19 is moved upwardly, the spacer 54 is taken out and the solidified residual iron 19 is again mounted on the solidified residual iron receiving table 47. At this time, the solidified residual iron receiving table 47 descends due to the deadweight of the solidified residual iron 19. However, the lower end surface of the solidified residual iron receiving table 47 is not grounded on the furnace bottom brick 17 and is apart. Accordingly, it is possible to take out the horizontal moving table 29 onto the rack rail 32 placed in the furnace body transferring truck 34 in a state of mounting the solidified residual iron 19 on the solidified residual iron receiving table 47 without taking out the solidified residual iron receiving table 47.

Figure 28:
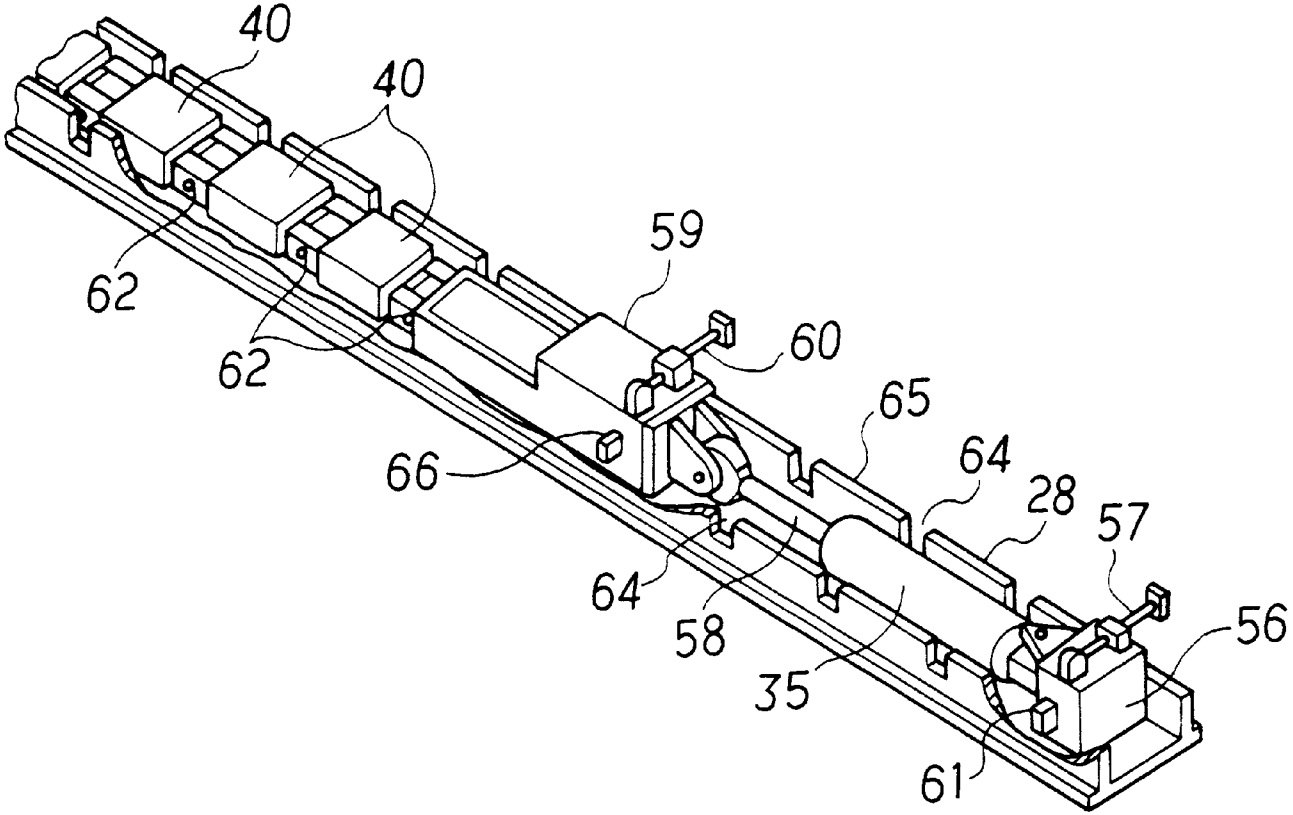
FIG. 28 is a perspective view showing a mechanism for making the slide show wait by the cylinder for moving along the groove type furnace inner rail.
Figure 29:
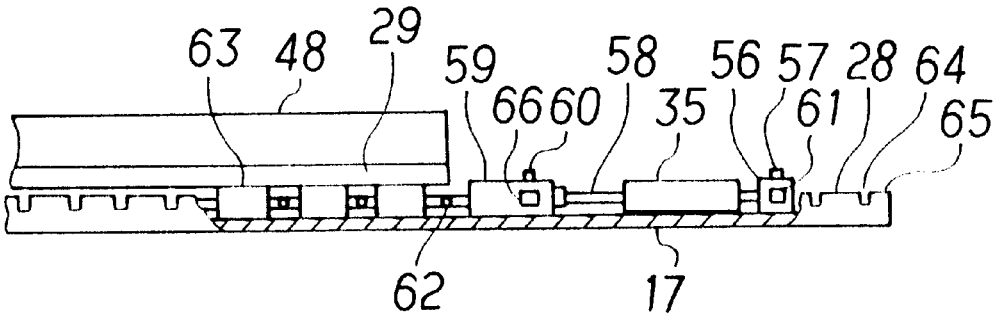
FIG. 29 is a front elevational view showing a mechanism for moving the slide shoe by the cylinder for moving along the groove type furnace inner rail.

The cylinder for moving 35 is, for example, horizontally arranged within the groove type furnace inner rail 28 in such a manner as to freely move in a longitudinal direction, as shown in FIGS. 28 and 29. Stopper notches 64 are provided on both side walls of the furnace inner rail 28 at a uniform interval to oppose to each other. Further, a first stopper cylinder 57 is horizontally arranged on an upper surface of a cylinder side metal member 56 for holding the cylinder for moving 35 to be vertical to the longitudinal direction of the furnace inner rail 28. A second stopper cylinder 60 is horizontally arranged on a rod side metal member 59 connecting via a piston rod 58 of a cylinder for moving 55 so as to be vertical to the longitudinal direction of the furnace inner rail 28. Further, a plurality of slide shoes 40 arranged in the lower portion of the horizontally moving table 29 via a connection pin 62 are connected to the rod side metal member 59.

A description will now be given of the method of moving the horizontal moving table 29. At first, the first stopper cylinder 57 is extended, and a stopper 61 connected to the first stopper cylinder 57 protrudes to both sides and engages with the stopper notches 64 provided on both side walls 65 of the furnace inner rail 28. At this time, a stopper 66 connected to the second stopper cylinder 60 is in a state of being retracted. The cylinder for moving 35 in a state of being extended is compressed, the rod 58 is moved to a compression side, and the rod metal member 59 and a plurality of slide shoes 40 are moved along the furnace inner rail 28. Accordingly, the horizontal moving table 29 on which the solidified residual iron receiving table 47 is arranged is moved in the direction of the outer portion of the furnace at a distance of one stroke of the cylinder for moving 35.

Next, the second stopper cylinder 60 is extended, and a stopper 66 connected to the second stopper cylinder 60 protrudes to both sides and engages with the stopper notches 64 provided on both side walls 65 of the furnace inner rail 28. On the contrary, the first stopper cylinder 57 is compressed, and the stopper 61 connected to the first stopper cylinder 57 is in a retracted state to be taken out from the stopper notches 64 provided on both side walls 65 of the furnace inner rail 28. The cylinder for moving 35 in a compressed state is extended and the cylinder side metal member 56 is moved in a direction of the outer portion of the furnace at a distance of one stroke.

Subsequently, the first stopper cylinder 57 extends, and the stopper 61 connected to the first stopper cylinder 57 protrudes to both sides and engages with the stopper notches 64 provided on both side walls 65 of the furnace inner rail 28. On the contrary, the second stopper cylinder 60 is compressed, the stopper 66 connected to the second stopper cylinder 60 is retracted to both sides to be taken out from the stopper notches 64 provided on both side walls 65 of the furnace inner rail 28, and the cylinder for moving 35 is compressed. The horizontal moving table 29 on which the solidified residual iron receiving table 47 is arranged is moved in the direction of the outer portion of the furnace by repeating the operations mentioned above.

In this case, a description is given of the method of moving the horizontal moving table 29 by using the cylinder for moving 35. However, it is possible to move the horizontal moving table 29 in the same manner by using a center hole jack or the like.

Figure 30:
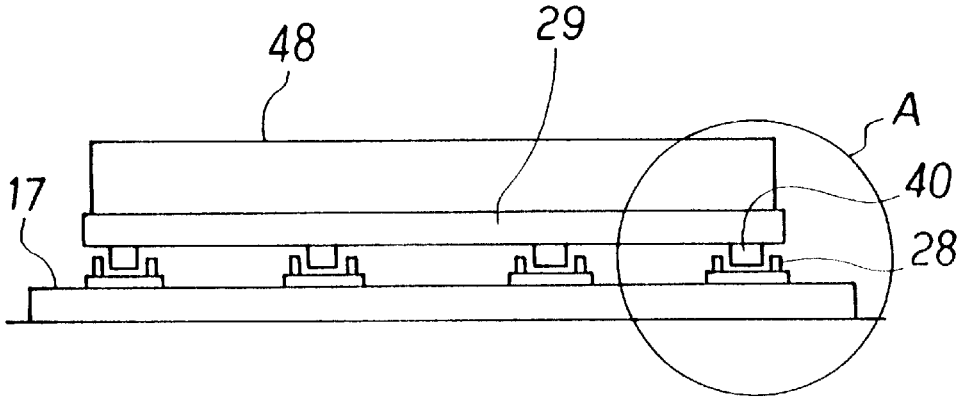
FIG. 30 is a side elevational view showing the state in which the slide shoe provided in a lower portion of the horizontal moving table is arranged in correspondence to the groove type furnace inner rail.
Figure 31:
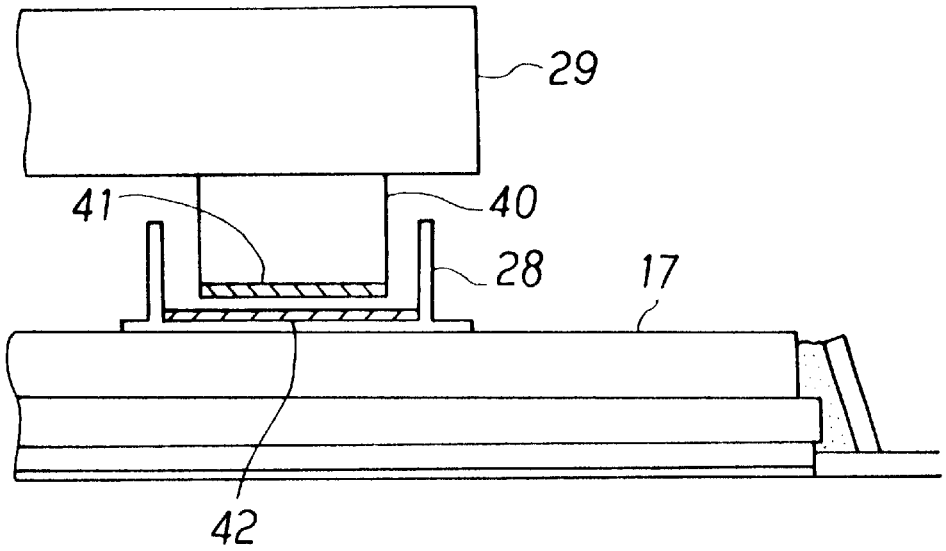
FIG. 31 is an enlarged side elevational view of a potion A from FIG. 30.

Further, as shown in FIG. 30, for example, four lines of slide shoes 40 are arranged in the lower portion of the horizontal moving table 29, and the slide shoes 40 slide along the groove type furnace inner rail 28 placed on the furnace bottom brick 17. As shown in FIG. 31, it is preferable to make the structure such that the Teflon® foot 41 is adhered to the lower surface of the slide shoe 40 and the stainless steel plate 42 is attached to the inner surface of the furnace inner rail 28 to make the coefficient of friction small.

Figure 32:
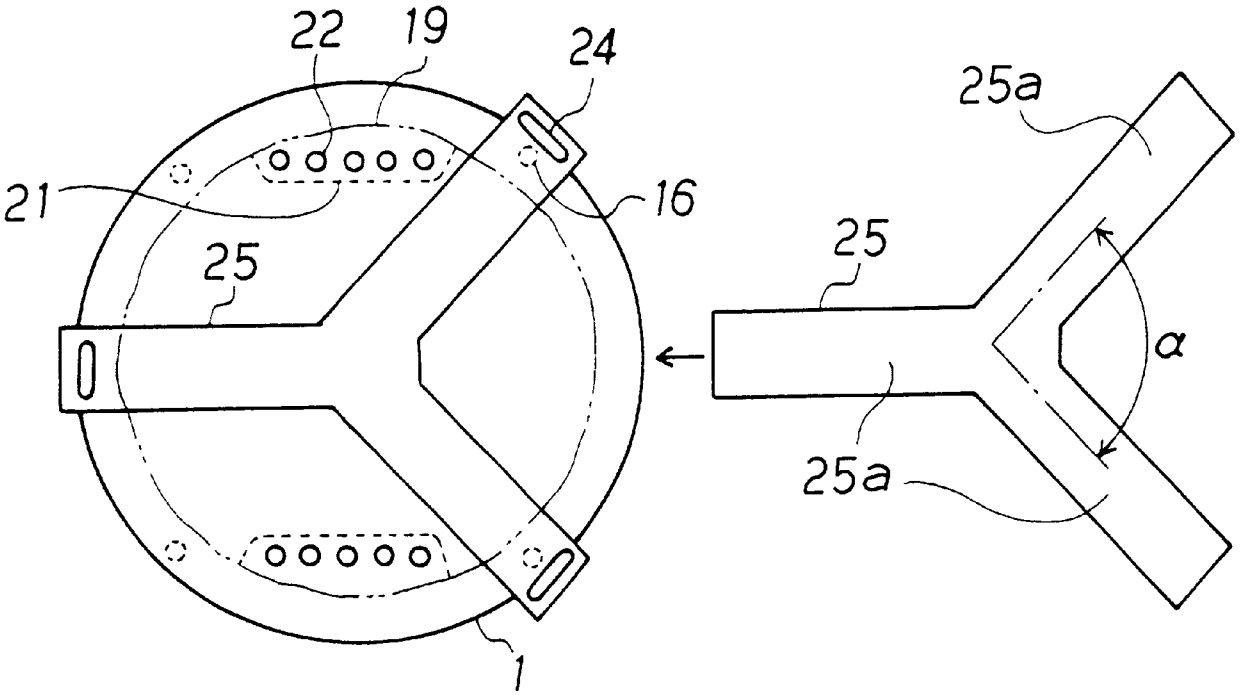
FIG. 32 is a plan view showing the state of using a Y-shaped suspending band.

Further, in accordance with the invention, it is preferable to make the structure such that the suspending band 25 integrally formed in a Y-shape shown in FIG. 32 is used. That is, one of rectangular bands 25*a* radially extending in three directions of the Y-shaped suspending band 25 is moved in a direction shown by the arrow in a state of being directed to a center of the blast furnace 10. A position at which the lifting-up jack 22 for jacking up the solidified residual iron 19 is placed is selected to a position at which the Y-shaped suspending band 25 is not interfered at the time of being moved. It is possible to stably suspend the solidified residual iron 19 by using the Y-shaped suspending band 25 in the manner mentioned above.

An angle of the rectangular band 25*a* radially extending in three directions of the Y-shaped suspending band 25 is not always required to be set to 120 degrees. When setting an angle $\alpha$ formed by two rectangular bands 25*a* positioned at the rear portion to 120 degrees or less (for example, about 90 degrees) in a state of moving the Y-shaped suspending band 25 toward the center of the blast furnace 10, the area for placing the lifting jack 22 is expanded, so that it is possible to stably jack up the solidified residual iron 19.

Figure 33:
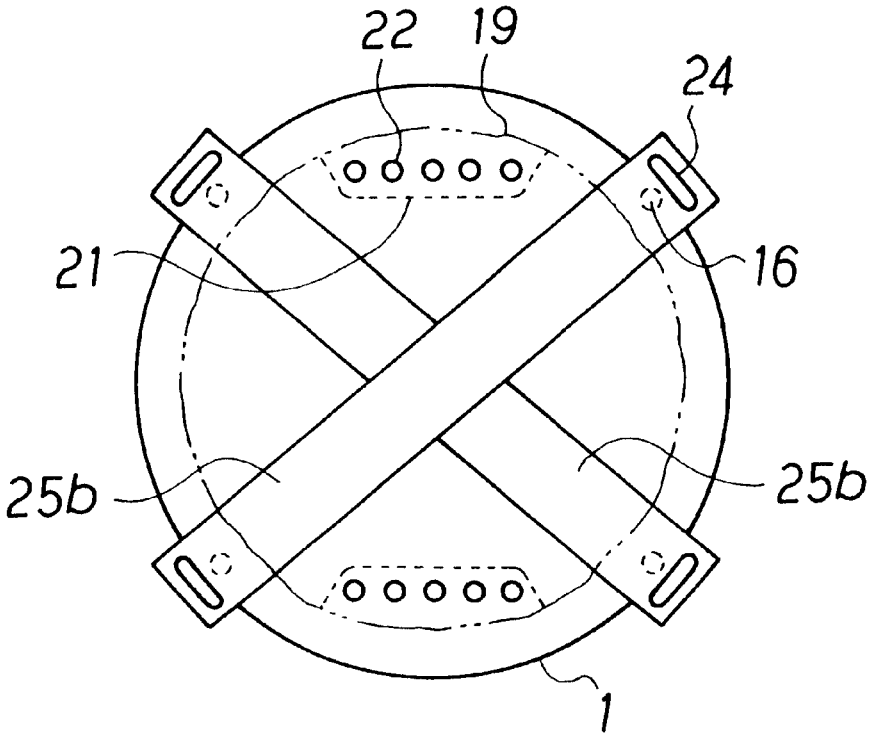
FIG. 33 is a plan view showing the state of crossing two band-like suspending bands to form an X shape.

In the case of using web-shaped suspending band 25*b* in place of the Y-shaped suspending band 25, it is preferable to form a structure such that two web-shaped suspending bands 25*b* are used by being crossed to form an X shape, as shown in FIG. 33. The angle formed by two web-shaped suspending bands 25*b* being crossed in an X shape is not particularly limited. However, when the lifting-up jack 22 is placed in an area having a larger angle among the angles formed by two web-shaped suspending bands 25*b*, it is possible to stably jack up the solidified residual iron 19.

As described above, in accordance with the invention, since the solidified residual iron 19 is vertically moved by the lift jack 16 placed in the supporting column 15 for supporting the blast furnace 10, it is not necessary to newly provide vertical moving means for the solidified residual iron 19. Further, since the solidified residual iron 19 is suspended by connecting the suspending band 25 to the shell side suspending device 24 fixed to the lower end portion of the upper furnace boy 1, it is possible to move the large lump of solidified residual iron 19 without separating it. Further, since the operation can be performed at high temperature, it is possible to reduce a time required for scrapping the furnace bottom section 11.

However, in the case that the weight of the solidified residual iron 19 is too heavy to be within an allowable range of the suspending band 25 and the vertical moving means, the solidified residual iron 19 may be suspended in accordance with the method mentioned above after being divided. Further, in the case that the size of the solidified residual iron 19 is too large to be conveyed, the solidified residual iron 19 may be divided on the horizontal moving table 29 after being mounted on the horizontal moving table 29.

Further, to stably suspend the solidified residual iron 19, the solidified residual iron 19 may be suspended by arranging a beam within the upper furnace body, connecting the beam t o the solidified residual iron 19 by employing the suspending member and using the suspending member and the supporting band 25 or piercing three or more holes in the solidified residual iron 19 to extend through the suspending rod.

What is claimed is:

1. A method of scrapping a furnace bottom section of a blast furnace comprising the steps of:

blowing out the furnace bottom section;

horizontally cutting a furnace body of the blast furnace at a position higher than solidified residual iron left in the furnace bottom section;

suspending an upper furnace body above the cutting position with a vertical moving means placed in a supporting column;

removing at least a part of a shell and a lining brick in a lower furnace body below said cutting position all around the periphery;

integrally connecting said upper furnace body and said solidified residual iron with a suspending device; and thereafter conveying said solidified residual iron out of the furnace with said vertical moving means.

2. A method of scrapping a furnace bottom section of a blast furnace according to claim 1, further comprising providing a plurality of cavities along a peripheral portion of said solidified residual iron and at a plurality of portions between said solidified residual iron and the furnace bottom brick before conveying said solidified residual iron out of the furnace, jacking up said solidified residual iron with a lifting jack arranged in said cavity to form a gap between said solidified residual iron and said furnace bottom brick, inserting a solidified residual iron suspending band into said gap, thereafter lowering said upper furnace body suspended in said supporting column with said vertical moving means so that said solidified residual iron suspending band is connected to said suspending device fixed to a lower portion of said upper furnace body, suspending said upper furnace body together with said solidified residual iron with said vertical moving means so that an operating space is formed between said solidified residual iron and said furnace bottom brick or a bottom plate of the blast furnace, moving a horizontal moving table on said furnace bottom brick or said bottom plate of the blast furnace, lowering said upper furnace body and said solidified residual iron with said vertical moving means so as to be mounted on said horizontal moving table, separating said suspending device fixed to the lower portion of said upper furnace body, moving upwardly said upper furnace body with said vertical moving apparatus, and moving said horizontal moving table mounting said solidified residual iron thereon from an inner portion of the furnace to an outer portion of the furnace.

3. A method of scrapping a furnace bottom section of a blast furnace according to claim 2, wherein said suspending device is fixed to a tuyere of said upper furnace body.

4. A method of scrapping a furnace bottom section of a blast furnace according to claim 2 or 3, further comprising flattening a surface layer portion of said furnace bottom brick under said operating space formed between said solidified residual iron and said furnace bottom brick, or removing said furnace bottom brick, placing a furnace inner rail on said furnace bottom brick or said bottom plate of the blast furnace, and moving said horizontal moving table on said furnace inner rail.

5. A method of scrapping a furnace bottom section of a blast furnace according to claim 2 or 3, further comprising flattening a surface layer portion of said furnace bottom brick under said operating space formed between said solidified residual iron and said furnace bottom brick, or removing said furnace bottom brick, moving said horizontal moving table having a solidified residual iron receiving table detachably arranged in a plurality of through holes onto said furnace brick or said bottom plate of the blast furnace, lowering said upper furnace body and said solidified residual iron with said vertical moving means to be mounted on said solidified residual iron receiving table, positioning a lower end surface of said solidified residual iron receiving table on said furnace bottom brick or said bottom plate of the blast furnace using deadweight of said solidified residual iron to form a construction space between said horizontal moving table and said furnace bottom brick or said bottom plate of the blast furnace, placing the furnace inner rail on said furnace bottom brick or said bottom plate of the blast furnace under said construction space, suspending said upper furnace body and said solidified residual iron with said vertical moving means so that said solidified residual iron receiving table is taken out from said horizontal moving table, lowering said upper furnace body and said solidified residual iron with said vertical moving means so as to be mounted on said horizontal moving table, removing said suspending device fixed to the lower end portion of said upper furnace body, upwardly moving said upper furnace body with said vertical moving apparatus, and moving said horizontal moving table mounting said solidified residual iron thereon to an outer portion of the furnace from an inner portion of the furnace.

6. A method of scrapping a furnace bottom section of a blast furnace according to claim 5, further comprising providing a receiving shelf in said through hole provided in said horizontal moving table, supporting said solidified residual iron receiving table to said receiving shelf via a plurality of springs by a bracket provided on an upper side surface thereof, separating a lower end surface of said solidified residual iron receiving table from said furnace bottom brick or said bottom plate of the blast furnace by an elastic force of said spring when said horizontal moving table is moved onto said furnace bottom brick or said bottom plate of the blast furnace, compressing said spring via said bracket when said solidified residual iron is mounted on said solidified residual iron receiving table so that the lower end surface of said solidified residual iron receiving table is positioned on said furnace bottom brick or said bottom plate of the blast furnace, and forming said construction space between said horizontal moving table and said furnace bottom brick or said bottom plate of the blast furnace.

7. A method of scrapping a furnace bottom section of a blast furnace according to claim 2 or 3, further comprising moving said horizontal moving table arranged on said furnace inner rail via a roller or a slide shoe arranged in a lower portion of said horizontal moving table.

8. A method of scrapping a furnace bottom section of a blast furnace according to claim 7, wherein said slide shoe is arranged within a groove formed in said furnace inner rail, a friction coefficient reducing member is interposed between said slide shoe and the groove formed in said furnace inner rail, and said horizontal moving table is moved by sliding motion along the groove formed in said furnace inner rail of said slide shoe.

9. A method of scrapping a furnace bottom section of a blast furnace according to claim 8, wherein said friction coefficient reducing member is made of Teflon® and/or stainless steel.

10. A method of scrapping a furnace bottom section of a blast furnace according to claim 2 or 3, wherein said solidified residual iron suspending band is formed in a Y shape.

11. A method of scrapping a furnace bottom section of a blast furnace according to claim 2 or 3, wherein a shape of said solidified residual iron suspending band is formed in a web shape, and said solidified residual iron is suspended by crossing two web-like solidified residual iron suspending bands to form an X shape.

12. A method of scrapping a furnace bottom section of a blast furnace according to claim 2 or 3, wherein said solidified residual iron is separated to be suspended together with said upper furnace body by said vertical moving means.

13. A method of scrapping a furnace bottom section of a blast furnace according to claim 2 or 3, wherein said solidified residual iron mounted on said horizontal moving table is separated.

14. A method of scrapping a furnace bottom section of a blast furnace according to claim 2 or 3, wherein a beam is arranged within said upper furnace body, said beam and said solidified residual iron are connected with the suspending member, and said solidified residual iron is suspended with said suspend member and said solidified residual iron suspending band.

* * * * *

UNITED STATES PATENT AND TRADEMARK OFFICE

CERTIFICATE OF CORRECTION

PATENT NO. : 6,479,011 B2 
DATED : November 12, 2002
INVENTOR(S) : Kojima et al.

It is certified that error appears in the above-identified patent and that said Letters Patent is hereby corrected as shown below:

Column 16,
Line 18, please change “suspend” to -- suspending --.

Signed and Sealed this

Twenty-second Day of April, 2003

JAMES E. ROGAN
*Director of the United States Patent and Trademark Office*